US005587868A

United States Patent [19]

Akutsu

[11] Patent Number: 5,587,868

[45] Date of Patent: Dec. 24, 1996

[54] HIGH VOLTAGE SPHERE-GAP DISCHARGE SWITCH, HIGH VOLTAGE PULSE GENERATION CIRCUIT AND HIGH VOLTAGE DISCHARGE SWITCHING METHOD

[75] Inventor: Kensuke Akutsu, Toyonaka, Japan

[73] Assignee: Nippon Paint Co., Ltd., Osaka, Japan

[21] Appl. No.: 390,607

[22] Filed: Feb. 17, 1995

[30] Foreign Application Priority Data

Feb. 21, 1994 [JP] Japan ..... 6-022265

[51] Int. Cl.[6] ..... H01T 1/20

[52] U.S. Cl. ..... 361/231; 307/106

[58] Field of Search ..... 361/231, 247, 361/251, 253, 256, 257, 14, 12, 123, 134; 307/106–110; 331/127; 218/43–52

[56] References Cited

U.S. PATENT DOCUMENTS

| | | | |
|---|---|---|---|
| 1,479,692 | 1/1924 | Bennett . | |
| 3,101,440 | 8/1963 | Early . | |
| 4,378,511 | 3/1983 | Simovitz, Jr. | 313/325 |
| 4,845,378 | 7/1989 | Garbe et al. | 307/106 |
| 5,371,649 | 12/1994 | Iwata et al. | 361/225 |

FOREIGN PATENT DOCUMENTS

| | | |
|---|---|---|
| 0287771 | 10/1988 | European Pat. Off. . |
| 5-339397 | 12/1993 | Japan . |
| 5-339398 | 12/1993 | Japan . |
| 393752 | 6/1933 | United Kingdom . |

*Primary Examiner*—Fritz Fleming

*Attorney, Agent, or Firm*—Shinjyu Office of Patent Attorneys

[57] ABSTRACT

A high voltage gap discharge switch is provided with a pair of sphere electrodes 1, projections 2 and a blower 5. The sphere electrodes 1 are separated by a discharge gap and oppose each other. The projections 2 are provided integrally at the mutually facing tips of the sphere electrodes 1, and have a projection length of 1/100 to 1/8 times the diameter of the sphere electrodes 1 and an outer diameter of 1/100 to 1/10 times. The blower 5 gives rise to an air current for expelling products produced on the projections 2 due to the generation of a spark discharge. The blower 5 supplies air to the discharge gap at a wind speed of 0.5 to 25 m/sec.-KW. One objective of the present invention is to stabilize the waveform of a high voltage pulse and to increase its durability using a simple construction.

8 Claims, 5 Drawing Sheets

HIGH VOLTAGE SPHERE-GAP DISCHARGE SWITCH, HIGH VOLTAGE PULSE GENERATION CIRCUIT AND HIGH VOLTAGE DISCHARGE SWITCHING METHOD

BACKGROUND OF THE INVENTION a) Field of the Invention

The present invention relates to switches, and in particular to high voltage sphere-gap discharge switches which operate by means of the generation of spark discharge.

b) Description of Related Art

Japanese Laying-open Patent Gazette No. S 63-66878 discloses a construction which employs a trigger electrode in addition to a pair of opposing electrodes, and in which a gas medium is supplied into and circulated within the discharged space. However, this construction requires an auxiliary circuit for the trigger, and the construction of the device is complicated.

Japanese Laying-open Patent Gazette No. S 58-35887 discloses a starting gap device in which a separate projection which can be extended and retracted is attached to one of a pair of sphere electrodes. However, the voltage in this device is in the region several hundred kilovolts and thus there is a lack of operational reproducibility, and moreover long term operation is problematical since consumption of the electrodes is high.

SUMMARY OF THE INVENTION

One object of the present invention is to achieve stability and durability of a high voltage pulse wave-form using a simple construction.

The discharge switch according to the present invention is a high voltage sphere-gap discharge switch which operates by means of the generation of spark discharge. This switch is provided with a pair of sphere electrodes, projections, and an air current generator. The above mentioned sphere electrodes oppose each other and are separated by a discharge gap. The above mentioned projections are provided integrally at both of the mutually facing tips of the above mentioned sphere electrodes and have a projection length of 1/100 to 1/8 times the diameter of the above mentioned sphere electrodes and an outer diameter of 1/100 to 1/10 times. The above mentioned air current generator gives rise to an air current for expelling products produced on the above mentioned projections due to the generation of the spark discharge.

Moreover, it is preferable for the above mentioned air current generator to supply air to the above ;mentioned discharge gap at a wind speed per unit electric power of 0.5 to 25 m/sec.-KW. Furthermore, it is preferable for air to be supplied at a wind speed of 3 to 20 m/sec.-KW. Furthermore, it is preferable for air to be supplied at a wind speed of 5 m/sec.-KW or more and less than 15 m/sec.-KW.

It is preferable for the above mentioned sphere electrodes to be made of hollow metal. It is further preferable for there to be provided a pair of ventilation openings for generating an air current in a direction intersecting the line joining the centers of the above mentioned pair of sphere electrodes, and furthermore for an insulating case to be provided, to house the above mentioned sphere electrodes. It is furthermore preferable that the above mentioned ventilation openings be positioned such that the straight line joining their centers intersects the straight line joining the centers of the above mentioned sphere electrodes in the center between the above mentioned sphere electrodes. It is furthermore preferable for the above mentioned ventilation opening on the air feed side to have a diameter of 1/4 to 3/4 times the outer diameter of the above mentioned sphere electrodes, and for the above mentioned ventilation opening on the exhaust side to have a diameter no less than that of the above mentioned ventilation opening on the air feed side.

It is preferable for there furthermore to be provided a discharge gap adjustment device for varying the gap between the above mentioned sphere electrodes.

The high voltage pulse generation circuit according to the present invention is provided with a charge and discharge means for the temporary accumulation of electrical power for supply to a capacitive load, a gap discharge switch for supplying the electrical power which has accumulated in the above mentioned charge and discharge means to the above mentioned capacitive load, and a resonance means for supplying the electrical power in the form of a high voltage pulse when it is supplied to tile above mentioned capacitive load. The above mentioned gap discharge switch is provided with a pair of sphere electrodes which oppose each other and are separated by a discharge gap, projections which are provided integrally at both mutually facing tips of the above mentioned sphere electrodes and which have a projection length of 1/100 to 1/8 times the diameter of the above mentioned sphere electrodes and an outer diameter of 1/100 to 1/10 times and an air current generator which gives rise to an air current for expelling products produced on the above mentioned projections, generated by the spark discharge.

The high voltage sphere-gap discharge method according to the present invention includes a process in which air is supplied to the above mentioned discharge gap at a wind speed of 0.5 to 25 m/sec.-KW, by means of the above mentioned air current generator, and a process in which a high voltage is applied between the above mentioned sphere electrodes.

Moreover, it is preferable for the process in which the above mentioned air is supplied to be a process in which air is supplied at a wind speed of 3 to 20 m/sec.-KW. It is furthermore preferable for the process in which the above mentioned air is supplied to be a process in which air is supplied at a wind speed of 5 m/sec.-KW or more and less than 15 m/sec.-KW.

It is preferable for the above mentioned projections to have a projection length of 1/100 to 1/8 times the outer diameter of the above mentioned sphere electrodes and an outer diameter of 1/100 to 1/10 times the outer diameter of the sphere electrodes.

It is furthermore preferable to include a process in which the discharge state is adjusted by varying the wind speed of the air which is supplied by means of the above mentioned air current generator, a process in which the discharge state is adjusted by varying the projection length of the above mentioned projections and the wind speed of the air supplied by means of the above mentioned air current generator, or a process in which the discharge state is adjusted by varying the open area of the above mentioned ventilation openings.

In the high voltage sphere-gap discharge switch according to the present invention, projections are provided integrally on a pair of sphere electrodes. A non-uniform electric field concentrates here, and corona discharge is generated under high voltage. In other words, the discharge generation position and the discharge arrival position are fixed at the projections. Furthermore, the air current brought about by means of the air current generator removes ions, metal dust and the like which form on the projections. In this way the discharge path is approximately fixed, and furthermore the discharge gap environment is maintained in a constant state, and thus it is possible to stabilize the wave-form of the high voltage pulse and to increase its durability using a simple construction.

Furthermore, when the above mentioned air current generator supplies air to the above mentioned discharge gap at a wind speed of 0.5 to 25 m/sec.-KW, the above mentioned action is more pronounced. Furthermore, when air is supplied at a wind speed of 3 to 20 m/sec.-KW, the above mentioned action is more pronounced. Furthermore, when air is supplied at a wind speed of 5 m/sec.-KW or more and less than 15 m/sec.-KW, the above mentioned action is more pronounced.

When the above mentioned sphere electrodes consist of hollow metal, the above mentioned action is more pronounced. Furthermore, when a pair of ventilation openings are provided to generate an air current in a direction intersecting the line joining the centers of the above mentioned pair of sphere electrodes, and an insulating case is furthermore provided to house the above mentioned sphere electrodes, the above mentioned action is more pronounced. Furthermore, when the above mentioned ventilation openings are positioned such that the straight line joining their centers intersects the straight line joining the centers of the above mentioned sphere electrodes in the center between the above mentioned sphere electrodes, the above mentioned action is more pronounced. Furthermore, when the above mentioned ventilation opening on the air feed side has a diameter ¼ to ¾ times the outer diameter of the above mentioned sphere electrodes, and the above mentioned ventilation opening on the exhaust side has a diameter which is no less than that of the above mentioned ventilation opening on the air feed side, the above mentioned action is more pronounced.

When there is furthermore provided a discharge gap adjustment device for varying the gap between the above mentioned sphere electrodes, the above mentioned action is more pronounced.

In the high voltage pulse generation circuit according to the present invention, firstly electrical power temporarily accumulates in the charge and discharge means. The electrical power which has accumulated in the above mentioned charge and discharge means is then supplied to the above mentioned capacitive load by the gap discharge switch discharging. At this time, the resonance means operates and the supplied electrical current is formed into a high voltage pulse shape.

In the high voltage sphere-gap discharge method according to the present invention, non-uniform electric fields are concentrated at the projections which are provided integrally on the pair of sphere electrodes, and the discharge generation position and the discharge arrival position are fixed at the projections. Furthermore, the air current brought about by means of the air current generator removes ions, metal dust and the like which form on the projections. In this way the discharge path is approximately fixed, and furthermore the discharge gap environment is maintained in a constant state, and thus it is possible to stabilize the wave-form of the high voltage pulse and to increase its durability using a simple construction.

Moreover, if the process in which the above mentioned air is supplied is a process in which air is supplied at a wind speed of 3 to 20 m/sec.-KW, the above mentioned action is more pronounced. Furthermore, if the process in which the above mentioned air is supplied is a process in which air is supplied at a wind speed of 5 m/sec.-KW or more and less than 15 m/sec.-KW, the above mentioned action is more pronounced.

Furthermore, if the above mentioned projections have a projection length 1/100 to ⅛ times the outer diameter of the above mentioned sphere electrodes and an outer diameter of 1/100 to 1/10 times the outer diameter of the sphere electrodes, the above mentioned action is more pronounced.

If there are further included a process in which the discharge state is adjusted by varying the wind speed of the air which is supplied by means of the above mentioned air current generator, a process in which the discharge state is adjusted by varying the projection length of the above mentioned projections and the wind speed of the air supplied by means of the above mentioned air current generator, or a process in which the discharge state is adjusted by varying the open area of the above mentioned ventilation openings, the above mentioned action is more pronounced in each case.

BRIEF DESCRIPTION OF THE DRAWINGS

These and other objects, features, aspects and advantages of the present invention will become more fully apparent from the following detailed description of the present invention when taken in conjunction with the accompanying drawings where like reference numerals denote corresponding parts throughout, in which.

DETAILED DESCRIPTION OF THE DRAWINGS

Figure 1:
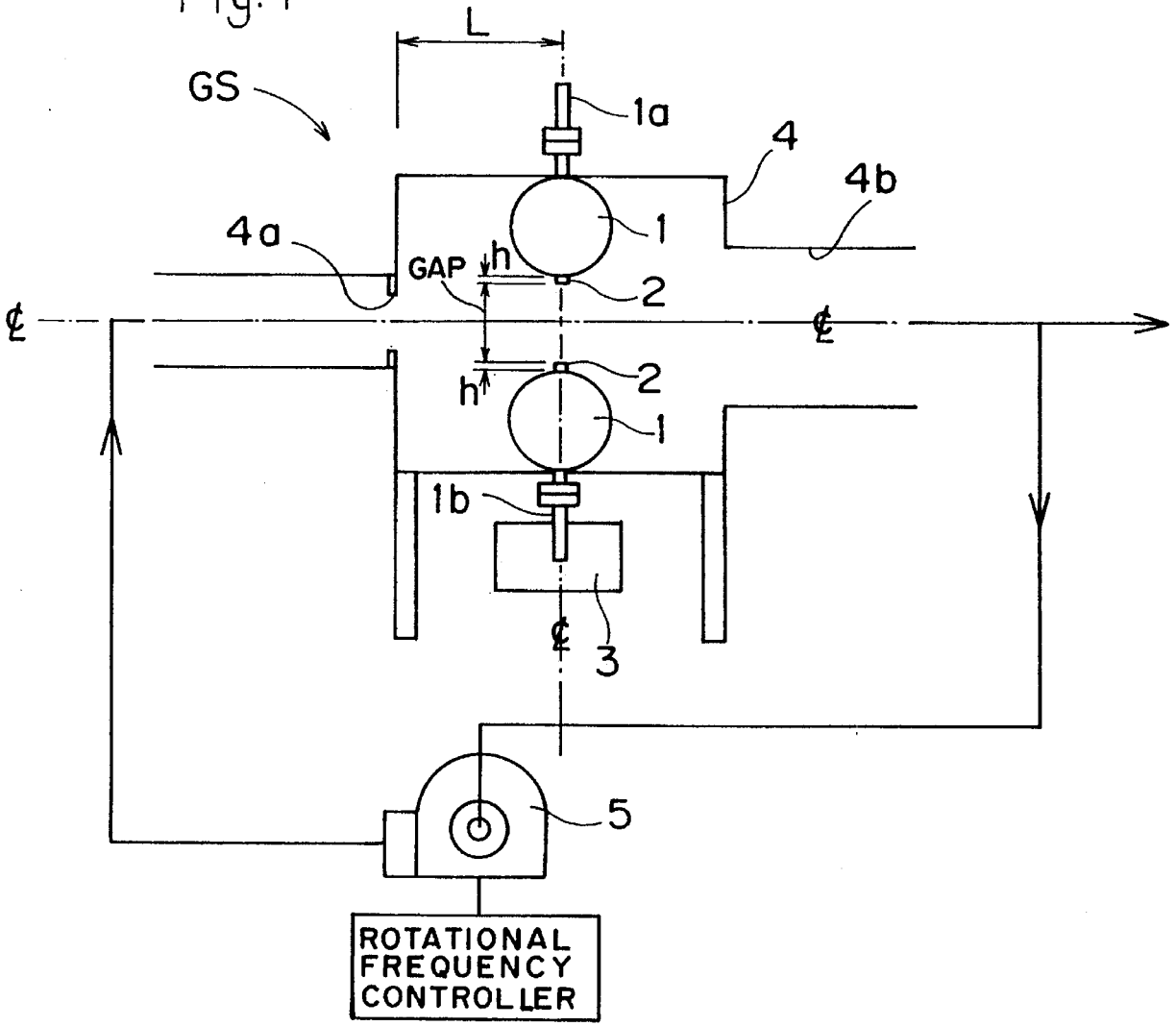
FIG. 1 is a schematic diagram of a gap discharge switch in accordance with one embodiment of the present invention.

In FIG. 1 which shows an example of a gap discharge switch according to the present invention, the gap discharge switch GS is provided with a pair of sphere electrodes 1 which are formed of a hollow metal with an outer diameter of 200mm, for example. The sphere electrodes 1 may also be solid. However, in order to simplify the construction of an insulating case 4, described hereinafter, which supports the sphere electrodes 1, it is preferable for the sphere electrodes 1 to be of a lightweight hollow spherical form.

Projections 2 are provided integrally at the facing tips of the above mentioned sphere electrodes 1. The sphere electrode 1 at the top of the diagram is the high voltage application side, and a high voltage terminal 1*a* is provided at the top end thereof. The sphere electrode 1 at the bottom of the diagram is the earth side, and an earth terminal 1*b* is provided at the bottom end thereof. Moreover, the center of the sphere electrodes 1, the projections 2, and the terminals 1*a* and 1*b* are positioned on a straight line.

The shape of the projections 2 is not particularly restricted provided that they are of a shape which projects from the spherical surface of the sphere electrodes 1. It is preferable for the shape to be cylindrical, cone-shaped, pyramid-shaped or cap-shaped, for example. The projection length of the projections 2 is 1/100 to 1/8 times the outer diameter of the sphere electrodes 1, and the outer diameter of the projections 2 is 1/100 to 1/10 times the outer diameter of the sphere electrodes 1.

The two terminals 1*a* and 1*b* are rod-shaped, and they may be of either circular rod shape or angular rod shape. Neither the outer diameter nor the length of the rods are particularly limited, but it is preferable for the outer diameter of the rods to be 1/20 to 1/5 times the outer diameter of the sphere electrodes, and for the length thereof to be 3/20 to 1/2 times the diameter of the sphere electrodes, in consideration of operability of the device.

The material of the sphere electrodes 1 should be a metal which is resistant to consumption due to repeated discharge, and the spheres are constructed from metallic elements such as stainless steel, steel or aluminum. Further, the material of the projections 2 is not particularly restricted provided it is a material which is used as an alloy for electrical contacts, and examples of such materials include those whose main components are metals selected from stainless steel, steel or tungsten, for example.

The sphere electrodes 1 are located within an insulating case 4 which is resistant to high applied voltages. The sphere electrodes 1 are supported in the insulating case 4 and are enclosed therein by the terminals 1*a* and 1*b* being secured to the insulating case 4. The material used for the insulating case 4 is not particularly restricted provided it is an insulator, examples of which include bakelite, vinylchloride, acrylic resin and FRP.

A pair of ventilation openings 4*a* and 4*b* are provided in the insulating case 4 in order to generate an air current in a direction perpendicular to a line joining the centers of the two electrodes 1. It is preferable for the ventilation openings 4*a* and 4*b* to be located such that the straight line joining the centers of the two ventilation openings 4*a* and 4*b* intersects the straight line joining the centers of the two sphere electrodes 1 in the center between the two sphere electrodes 1. It is preferable for the diameter of the ventilation opening 4*a* on the air feed side (on the left in the diagram) to be 1/4 to 3/4 times the outer diameter of the sphere electrodes 1. The diameter of the ventilation opening 4*b* on the exhaust side (on the right in the diagram) should be equal to or greater than that of the ventilation opening 4*a*.

The ventilation opening 4*a* is connected to the air blowing unit of a blower 5, the rotational frequency of which can be controlled. Further, the ventilation opening 4*b* is open to the atmosphere. Examples of the blower 5 include a limit fan and a turbo fan with a relatively high static pressure. An exhaust device may also be used instead of the blower 5. In this case, the exhaust device is connected to the ventilation opening 4*b*. Examples of exhaust devices include a cyclofan with a relatively low static pressure.

The earth terminal 1*b* is connected to a discharge gap adjustment device 3 which is located outside the insulating case 4. The adjustment device 3 can adjust the discharge gap between the projections 2 from approximately zero to a dimension approximately equal to the diameter of the sphere electrodes, by raising and lowering the earth terminal 1*b*. The adjustment device 3 is, for example, a manual jack. Further, a cylinder which is moved up and down pneumatically or hydraulically may also be used as the adjustment device 3. Furthermore, it is possible to have a construction in which both of the sphere electrodes 1 are linked to separate adjustment devices 3.

The outer diameter of the sphere electrodes 1 and the minimum discharge gap are set by means or the adjustment device 3 such that they are approximately equal. For example, if the maximum voltage applied to the sphere electrodes 1 is approximately 175 KV and the outer diameter of the sphere electrodes 1 is 200 mm, then the discharge gap is set to 140 to 200mm.

Figure 2:
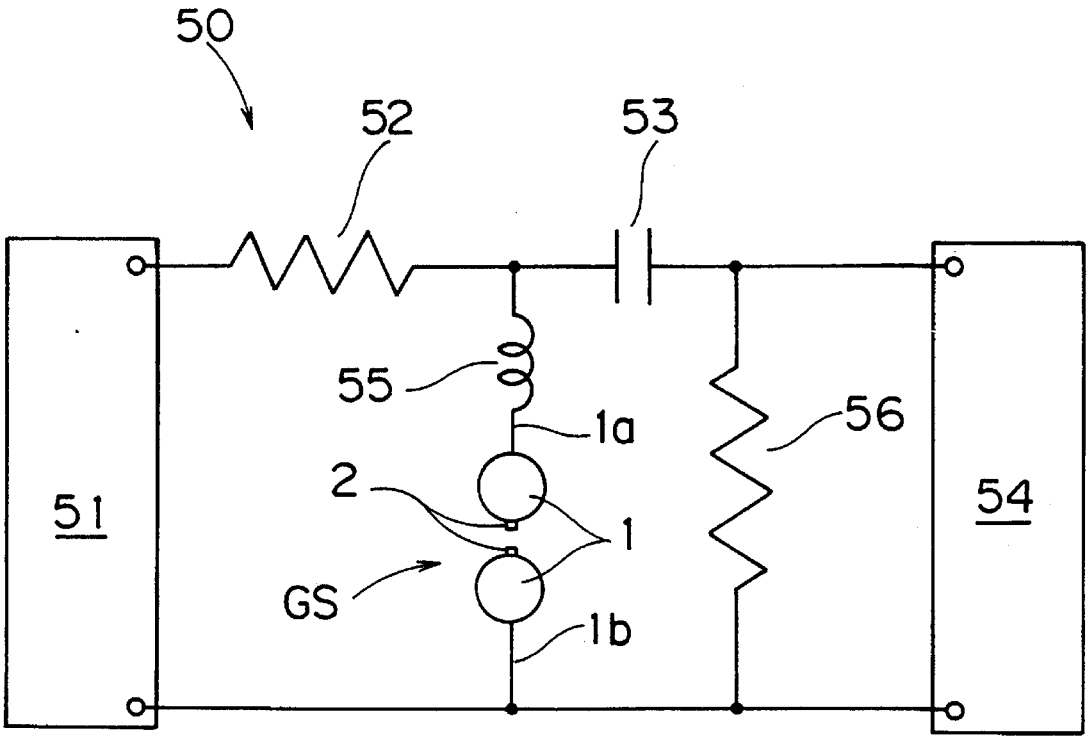
FIG. 2 is a schematic circuit diagram showing a high voltage pulse generation circuit associated with the gap discharge switch depicted in FIG. 1.

The gap discharge switch GS is incorporated into the high voltage pulse generation circuit 50 shown in FIG. 2. Here, a capacitive load 54 is connected to the output side of a direct current power supply 51 via a protection resistor 52 and a charge and discharge condenser 53 which are connected in series. Furthermore, a load resistor 56 is located in parallel with the capacitive load 54.

The high voltage terminal 1*a* of the gap discharge switch GS is connected between the protection resistor 52 and the charge and discharge condenser 53, via an inductor 55. The earth terminal 1*b* of the gap discharge switch GS is connected to the capacitive load 54 and the load resistor 56.

The action of the above mentioned embodiment will now be described.

As the voltage of the power supply 51 increases, eventually a spark discharge will be generated between the sphere electrodes 1 of the gap discharge switch GS, and the gap will be shorted. As a result, the potential between the two electrodes 1 will change rapidly to zero and the discharge path will disappear, breaking the circuit. In this period, the charge which has accumulated in the charge and discharge condenser 53 will proceed instantaneously to the load side due to the rapid change in the potential, and a high voltage pulse will be generated due to the resonance phenomenon determined by the circuit constants of the impedance of the inductor 55, the load resistor 56 and the charge and discharge condenser 53, and will be applied to the capacitive load 54.

Here, it is necessary that the spark discharge be broken instantaneously. If the spark discharge continues for a long time then the output of the direct current passed by 51 will be shorted, and the pulse generation will stop without sufficient power having been supplied. For this reason the resistance value of the protection resistor 52 must be of a value which is sufficiently large to keep the current at or below the rated current value even if the short circuit continues, and in this way the power supply 51 is protected.

In the discharge action described above, non-uniform electric fields concentrate at the tips of both projections 2, and as the voltage increases a spark discharge is generated reliably between both projections 2. For these reasons, the spark discharge is generated with greater reproducibility and stability if the projections 2 are provided, rather than with only the sphere electrodes 1. However, since the projections 2 are formed integrally with the sphere electrodes 1, the construction is simple.

In the high voltage sphere-gap discharge switch GS, products such as ions and metal dust are generated specifically at the projections 2, and thus it is possible to remove these products efficiently. For the removal of the products it is preferable to supply air to the discharge gap at a wind speed of 0.5 to 25 m/sec.-KW.

This is for the following reasons. With constant discharge gap conditions, the spark discharge path tends to be difficult to break when the wind speed of the supplied air is low. As a result, the peak of the pulse wave is lowered, the pulse repetition frequency is increased and it is difficult to obtain a spark discharge after the voltage has been sufficiently increased. Under these conditions stable control is impossible and in pronounced cases breaking of the circuit is impossible. Conversely, when the wind speed of the supplied air is greater than is necessary, the peak of the pulse wave is sufficiently high, but an adequate pulse repetition frequency is not achieved and in extreme cases the spark discharge is not generated. For such reasons it is preferable for the wind speed of the supplied air to be in the range 0.5 to 25 m/sec.-KW. However, from considerations of the cost of the air supply device it is more preferable for the air to be supplied at a wind speed of 3 to 20 m/sec.-KW.

The wind speed of the supplied air and the discharge gap have a large effect on the pulse wave peak and the pulse repetition frequency. Over an extended period it is not possible to obtain a high voltage pulse in which a stable pulse wave peak and pulse repetition frequency are maintained, merely by adjusting the discharge gap. In order to control the high voltage sphere-gap discharge switch GS in a stable condition it is necessary for the air which removes ions and metal dust and the like, generated at the projections 2, to be supplied appropriately.

Moreover, since the high voltage pulse generation circuit 50 which employs the high voltage sphere-gap discharge switch GS can produce a high voltage pulse continuously over a long period at low cost, it can be used in various industrial applications. For example, it can be used in a plasma generating device aimed at improving the surface of plastic.

Experiment 1

Experiments were performed using the device of FIG. 1. It should be noted that the sphere electrodes 1 consisted of hollow metal with an outer diameter of 200 mm, and the projections 2 had a projection dimension (projection length) h=10 mm, and a projection diameter TD=10 mm. The width, depth and height of the insulating case 4 were all 700 mm, in order to resist high applied voltages, and a sufficient space was left between the discharge gap and the insulating case 4. The discharge gap GAP was 150 mm, the diameter of the ventilation opening **4*a* was 75 mm and the diameter of the ventilation opening 4*b*** was 260 mm. Further, the distance L from the supply opening to the center of the discharge gap was 350 mm.

Figure 3:
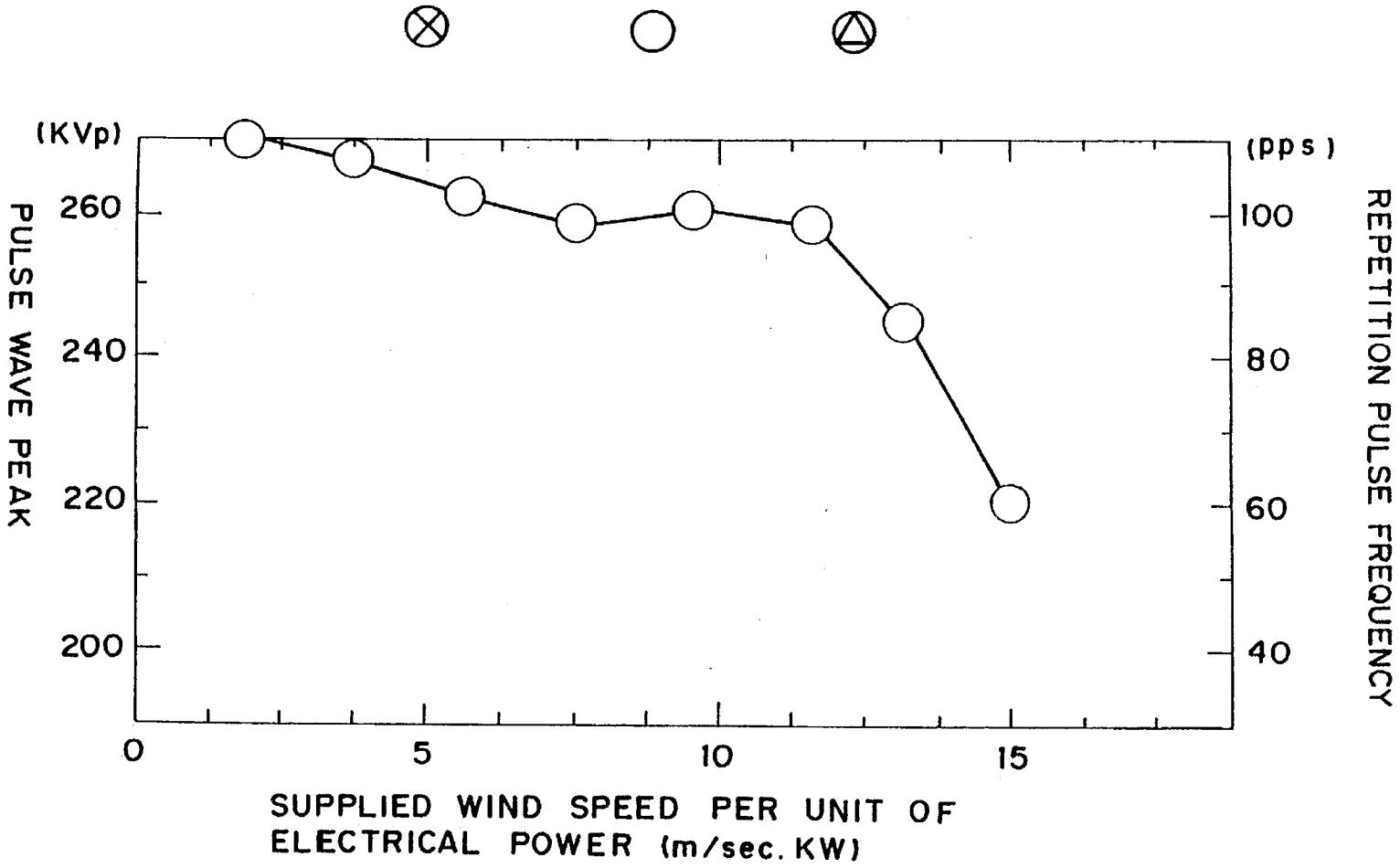
FIG. 3 is a chart showing characteristics of the gap discharge switch as a function of the supplied wind speed per unit of electrical power.

Varying the wind speed of air supplied by means of the blower 5, measurements were made of the pulse wave peak and the repetition pulse frequency generated when the direct current applied voltage was 175 KV. The measured results are shown in FIG. 3. In FIG. 3, ⓧ means an assessment of "spark discharge was not broken, the condition was unstable, the repetition frequency was high and the width of the pulse wave peak was large", ○ means an assessment of "switch operation was possible due to stable discharge", and Ⓐ means an assessment of "generation of spark discharge was unstable and discontinuous, and the repetition frequency was low".

The following items (1) to (4) became clear as a result.

(1) When the wind speed of the supplied air is less than 0.5 m/sec.-KW there is a strong tendency for the spark discharge not to be broken, and stable switch operation is impossible.

(2) When the wind speed of the supplied air is in the range of more than 0.5 m/sec.-KW and less than 5 m/sec.-KW, it is unstable but switch operation is possible. The repetition pulse frequency is at least 100 pps, but the pulse wave peak is 200 to 230 KV, the amplitude is large and the average value is low.

(3) When the wind speed of the supplied air is in the range of more than 5 m/sec.-KW and less than 15 m/sec.-KW, the pulse wave peak is 210 to 230 KV, the amplitude of variation is small and the average value reached is 220 KV. The repetition pulse frequency is approximately 100 pps and stable spark discharge is generated.

(4) When the wind speed of the supplied air is in the range of 15 m/sec.-KW or more, a high pulse wave peak of 220 KV or more is obtained but the repetition pulse frequency is significantly lowered.

As outlined above, when the wind speed of the supplied air is in the range of 5 m/sec.-KW more and less than 15 m/sec.-KW then a stable spark discharge is generated and reliable switch operation is achieved. It was also confirmed that this can be maintained even during extended period continuous operation.

Experiment 2

Experiments were performed using the device of FIG. 1. It should be noted that the sphere electrodes 1 consisted of hollow metal with an outer diameter of 200 mm, and the projections 2 had a projection dimension (projection length) h=10 mm, and a projection diameter TD=10 mm. The width, depth and height of the insulating case 4 were all 700 mm, in order to resist high applied voltages, and a sufficient space was left between the discharge gap and the insulating case 4. The discharge gap GAP was 150 mm, the diameter of the ventilation opening **4*a* was 50 mm and the diameter of the ventilation opening 4*b*** was 260 mm. Further, the distance L from the supply opening to the center of the discharge gap was 350 mm.

Figure 4:
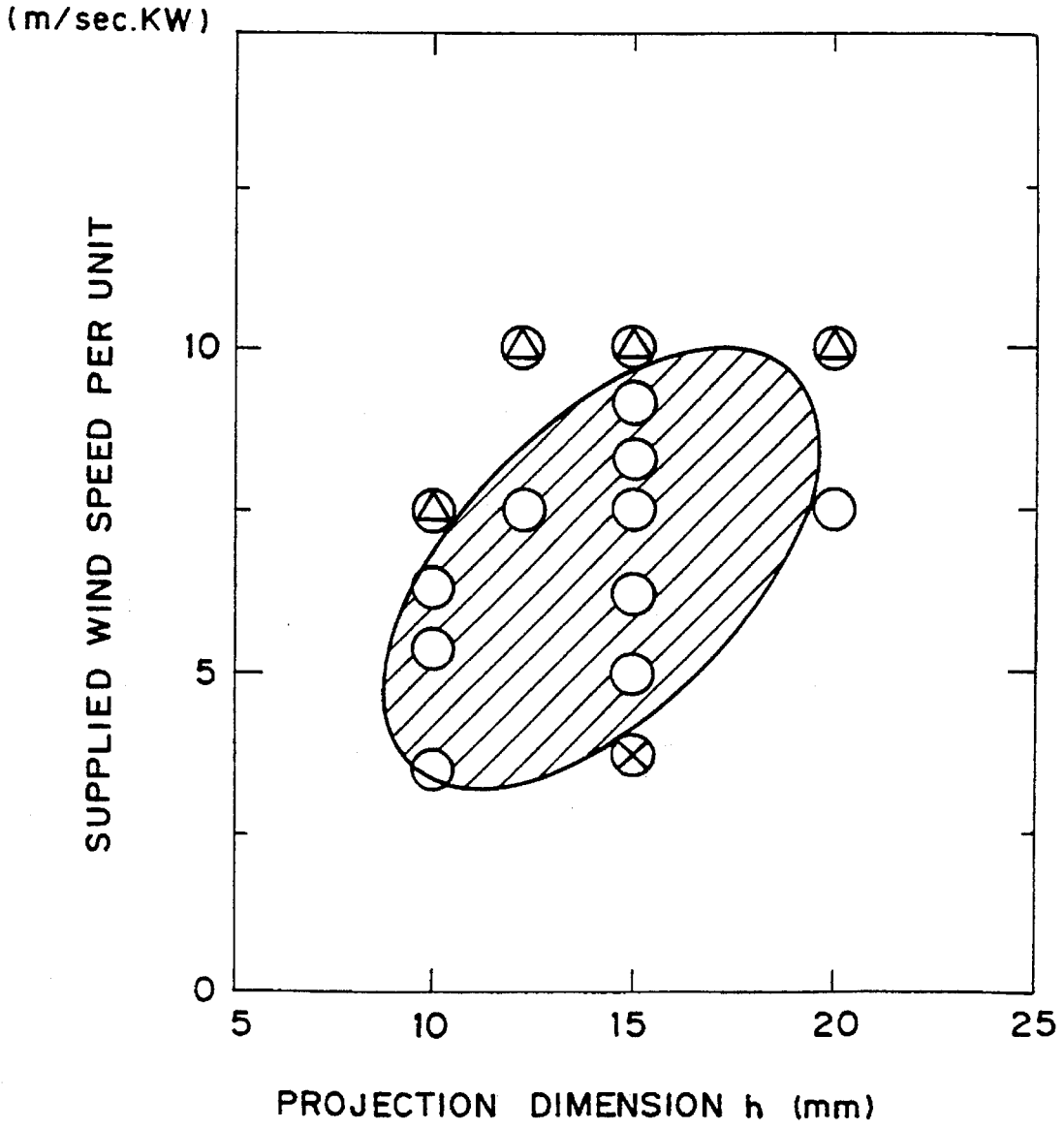
FIG. 4 is a chart showing the characteristics of the gap discharge switch as a function of the length of projections of the switch.

FIG. 4 shows the experimental results obtained when the projection length of the projections 2 and the wind speed of the supplied air were varied. The diagonally shaded region of FIG. 4 can be regarded as the region in which switch operation due to spark discharge is performed reliably. In other words the region in which the projection electrode length h is 8 to 20 mm and the supply wind speed is 3 to 10 m/sec.-KW is the region in which satisfactory switch operation is possible. It should be noted that ⓧ, ○ and Ⓐ in FIG. 4 have the same meanings as in FIG. 3.

Experiment 3

Figure 5:
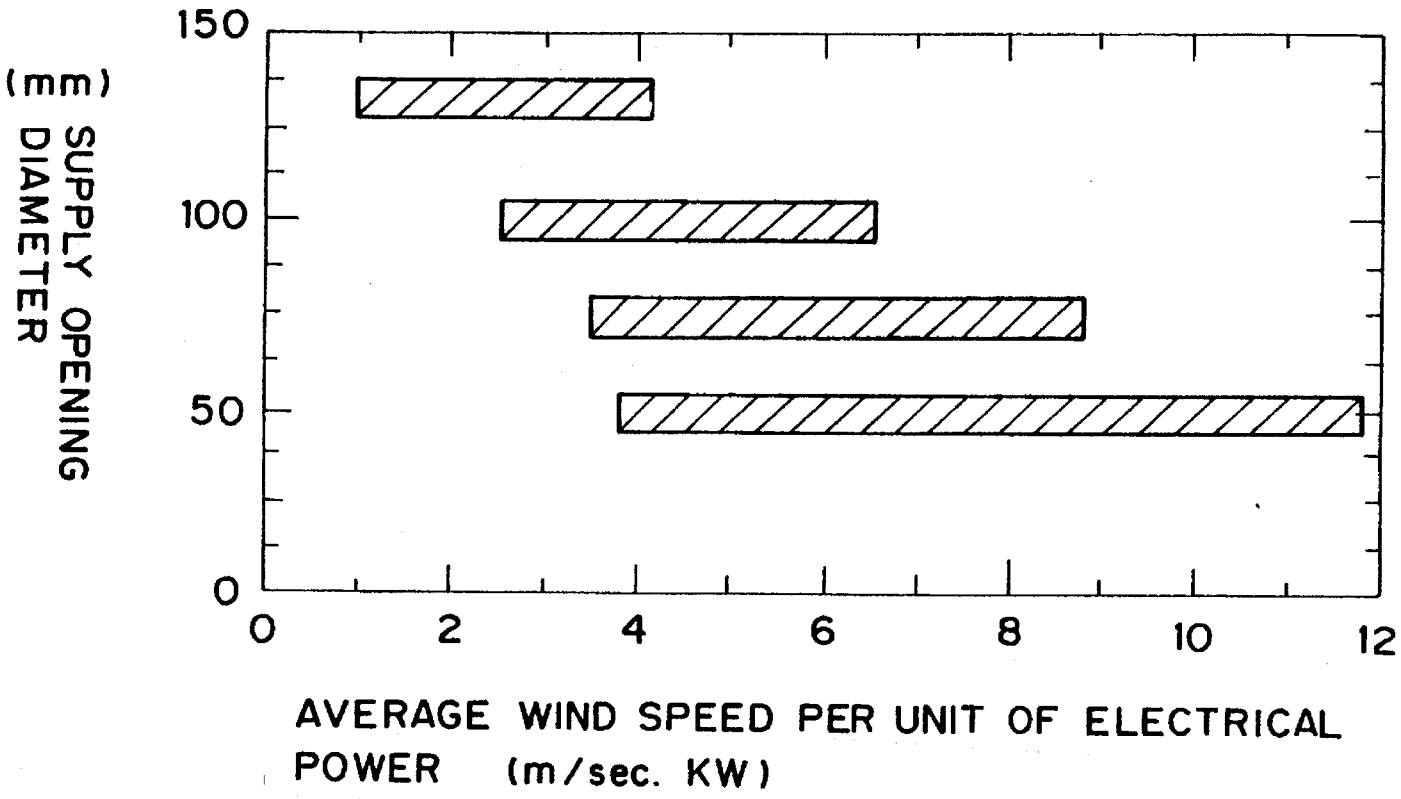
FIG. 5 is a chart showing stable regions for different diameters of air supply openings in the gap discharge switch depicted in FIG. 1.

Experiments were performed using the same device as in Experiment 2, varying the supply wind speed and the diameter of the supply side ventilation opening. FIG. 5 shows the results, moreover the diagonally shaded region in FIG. 5 is the stable region.

It can be seen from this experiment that the range of variation of the wind speed of the supplied air in order for the switch operation due to spark discharge to operate stably increases as the diameter of the air supply aperture decreases.

Advantages of the invention

The discharge switch according to the present invention is provided with projections and an air current generator as outlined above, and thus the discharge path is approximately specified and the discharge gap environment is maintained in a constant state. It is thus possible to stabilize the wave-form of the high voltage pulse and to increase its durability using a simple construction.

It should be noted that when the above mentioned air current generator supplies air to the above mentioned discharge gap at a wind speed of 0.5 to 25 m/sec.-KW, the above mentioned effects are more pronounced. Furthermore, when air is supplied at a wind speed of 3 to 20 m/sec.-KW the above mentioned effects are more pronounced. Furthermore, when air is supplied at a wind speed of 5 m/sec.-KW or more and less than 15 m/sec.-KW the above mentioned effects are more pronounced.

When the above mentioned sphere electrodes consist of hollow metal, the above mentioned action is more pronounced. Furthermore, when a pair of ventilation openings are provided to generate an air current in a direction intersecting the line joining the centers of the above mentioned pair of sphere electrodes, and an insulating case is furthermore provided to house the above mentioned sphere electrodes, the above mentioned action is more pronounced. Furthermore, when the above mentioned ventilation openings are positioned such that the straight line joining their centers intersects the straight line joining the centers of the above mentioned sphere electrodes in the center between the above mentioned sphere electrodes, the above mentioned action is more pronounced. Furthermore, when the above mentioned ventilation opening on the air feed side has a diameter ¼ to ¾ times the outer diameter of the above mentioned sphere electrodes, and the above mentioned ventilation opening on the exhaust side has a diameter which is no less than that of the above mentioned ventilation opening on the air feed side, the above mentioned action is more pronounced.

When there is furthermore provided a discharge gap adjustment device for varying the gap between the above mentioned sphere electrodes, the above mentioned action is more pronounced.

The same effects as in the above mentioned discharge switch can also be obtained with the high voltage pulse generation circuit according to the present invention.

The same effects as in the above mentioned discharge switch can also be obtained with the high voltage sphere-gap discharge method according to the present invention.

Moreover, if the process in which the above mentioned air is supplied is a process in which air is supplied at a wind speed of 3 to 20 m/sec.-KW, the above mentioned action is more pronounced. Furthermore, if the process in which the above mentioned air is supplied is a process in which air is supplied at a wind speed of 5 m/sec.-KW or more and less than 15 m/sec.-KW, the above mentioned action is more pronounced.

Furthermore, if the above mentioned projections have a projection length 1/100 to ⅛ times the outer diameter of the above mentioned sphere electrodes and an outer diameter of 1/100 to 1/10 times the outer diameter of the sphere electrodes, the above mentioned action is more pronounced.

If there are further included a process in which the discharge state is adjusted by varying the wind speed of the air which is supplied by means of the above mentioned air current generator, a process in which the discharge state is adjusted by varying the projection length of the above mentioned projections and the wind speed of the air supplied by means of the above mentioned air current generator, or a process in which the discharge state is adjusted by varying the open area of the above mentioned ventilation openings, the above mentioned action is more pronounced in each case.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed:

1. A high voltage sphere-gap discharge switch which operates by means of the generation of spark discharge comprising:

a support structure;

a pair of sphere electrodes mounted to said support structure which oppose each other and are separated by a discharge gap, projections formed on mutually facing portions of said sphere electrodes and which have a projection length of 1/100 to ⅛ times the diameter of said sphere electrodes and an outer diameter of 1/100 to 1/10 times of said sphere electrodes, and an air current generator associated with said support structure which selectively supplies an air current through said support structure for expelling products produced on the above mentioned projections, generated by the spark discharge;

wherein a pair of ventilation openings are provided on opposite sides of said support structure to allow an air current in a direction which intersects a line joining the centers of said pair of sphere electrodes, and said support structure includes an insulating case which houses said sphere electrodes.

2. The high voltage sphere-gap discharge switch as in claim 1, wherein said air current generator supplies air to said discharge gap at a wind speed of 0.5 to 25 m/sec.-KW.

3. The high voltage sphere-gap discharge switch as in claim 1, wherein said air current generator supplies air to said discharge gap at a wind speed of 3 to 20 m/sec.-KW.

4. The high voltage sphere-gap discharge switch as in claim 3, wherein said air current generator supplies air to said discharge gap at a wind speed of greater than 5 m/sec.-KW, and less than 15 m/sec.-KW.

5. The high voltage sphere-gap discharge switch as in claim 1, wherein said sphere electrodes comprise hollow metal.

6. The high voltage sphere-gap discharge switch as in claim 1, wherein said ventilation openings are located on opposite sides of said support structure and are aligned such that a straight line joining their centers intersects a straight line intersecting the centers of said sphere electrodes at the center between said sphere electrodes.

7. The high voltage sphere=gap discharge switch as in claim 1, wherein said ventilation opening on an air feed side has a diameter which is ¼ to ¾ times the outer diameter of said sphere electrodes, and said ventilation opening on an exhaust side has a diameter which is no less than that of said ventilation opening on the air feed side.

8. The high voltage sphere-gap discharge switch as in claim 1, wherein a discharge gap adjustment device disposed within said support structure supports at least one of said sphere electrodes for varying the gap between said sphere electrodes.

* * * * *